United States Patent [19]

Reeder et al.

[11] Patent Number: 4,696,652

[45] Date of Patent: Sep. 29, 1987

[54] PORTABLE, FOLDABLE REPLICA OF A FACADE OF COMMERCIAL ESTABLISHMENTS

[76] Inventors: James A. Reeder; Joanne E. Reeder, both of 101 Roxie Ave., North Beach, N.J. 08008

[21] Appl. No.: 876,378

[22] Filed: Jun. 19, 1986

[51] Int. Cl.[4] ..... A63H 33/04; A63H 3/52

[52] U.S. Cl. ..... 446/75; 446/478

[58] Field of Search ..... 446/75, 73, 7, 82, 104, 446/476, 478, 482, 487

[56] References Cited

U.S. PATENT DOCUMENTS

| | | | |
|---|---|---|---|
| 983,133 | 1/1911 | Goldfield | 446/478 |
| 1,128,031 | 2/1915 | Needleman | 446/478 |
| 1,245,872 | 11/1917 | Colborne | 446/73 |
| 1,263,282 | 4/1918 | Pente | 446/476 |
| 1,600,554 | 9/1926 | Marquis | 446/75 |
| 1,756,526 | 4/1930 | Thompson | 446/75 |
| 1,787,978 | 1/1931 | Gilmond | 446/478 |
| 1,961,957 | 6/1934 | Bock | 446/75 |
| 3,182,420 | 5/1965 | Bender | 446/478 |

*Primary Examiner*—Philip C. Kannan

*Attorney, Agent, or Firm*—Ralph R. Roberts

[57] ABSTRACT

This replica device or toy is structured to suggest commercial establishments such as a post office, bank, hotel, and the like. This replica device is made with a main and two side-hinged panel members with outward-swinging limiting means. The device, when open for use, has a selectively open and closed window, shelf and a box door. Signs indicating the establishment's represented usage are also provided. Bank teller apparatus and post office rental boxes are provided. A minimum of loose components is shown, but accessories are provided so that children may use this device with a minimum of imagination. In storage condition, this device is about suitcase size and of light weight. This device is intended for use by two or more grade school children.

14 Claims, 2 Drawing Figures

PORTABLE, FOLDABLE REPLICA OF A FACADE OF COMMERCIAL ESTABLISHMENTS

BACKGROUND OF THE INVENTON

1. Field of the Invention

With reference to the field of art as established in and by the U.S. Patent Office, this invention is believed to be found in the general class entitled "Amusement Devices, Toys," and, in particular, to portable and foldable replicas of commercial establishments such as post office, banks, stores and the like, which are quite familiar to children going to grade school.

2. Description of the Prior Art

This invention is similar to the inventions shown in the prior art in that store fronts are shown. The prior art includes U.S. Pat. No. 1,787,978, as issued to GILMOND on Jan. 6, 1931; No. 1,961,957, as issued to BOCK on June 5, 1934; No. 3,182,420, as issued to BENDER on May 11, 1965; No. 1,245,872, as issued to COLBORNE on Nov. 6, 1917; No. 1,600,554, as issued to MARQUIS on Sept. 21, 1926, and No. 1,128,031, as issued to NEEDLEMENT on Feb. 9, 1915. The present invention provides apparatus whereby the participants may be equal participants whether on the outside or the inside of the replica apparatus. GILMOND (1,787,978), although depicting a store, has on its inside shelving only storage. This patented toy store does not suggest or show a replica device particularly adapted for plural participants. BOCK (1,961,957) is a convertible play box which shows convertibility. BENDER (3,182,420) shows a doll house which may be used for one child, but does not suggest participation by two or more. COLBORNE (1,245,872) is an advertising novelty display. MARQUIS (1,600,554) shows a stage for puppets and the like. NEEDLEMENT (1,128,031) shows a grocery store with shelving, and the comment for GILMOND is also appropriate in conjunction with this patent.

SUMMARY OF THE INVENTION

This invention may be summarized in relation to its object. It is an object of this invention to provide, and it does provide, a portable, foldable replica of a facade of commercial establishments. This device is adapted to be used by a plurality of juveniles, with said device permitting and indeed encouraging participation on both sides of the apparatus by the participants.

In brief, the present invention provides a portable and foldable device much like a suitcase or an attache case in which a large face extent is provided with a barred window area, and immediately below is a closable slot or door that is selectively opened by a lever device interior thereof. Indicia to show "open" and "closed." as well as slots for letters and for stamps are also provided. Two wing panels or portions are hingedly attached to said front extent and one attached member provides date and day information as well as push buttons. The other panel includes a multiplicity of post office boxes with key locks. The interior of this device provides a key holder for the keys used to open the lock doors. A toy microphone, telephone and a stamp and cash drawer are provided. A sliding panel is provided to close the window.

In addition to the above summary, the following disclosure is detailed to insure adequacy and aid in understanding of the invention. This disclosure, however, is not intended to cover each new inventive concept no matter how it may later be disguised by variations in form or additions of further improvements. For this reason, there has been chosen a specific embodiment of a portable and foldable replica of a facade of businesses or commercial establishments as adopted for use by at least a plurality of juveniles and showing a preferred means of construction and arrangement of essential components. This specific embodiment has been chosen for the purposes of illustration and description as shown in the accompanying drawings wherei:

BRIEF DESCRIPTION OF THE DRAWINGS

In the following description and in the claims, various details are identified by specific names for convenience. These names are intended to be generic in their application. Corresponding reference characters refer to like members throughout the several figures of the drawings.

Figure 1:
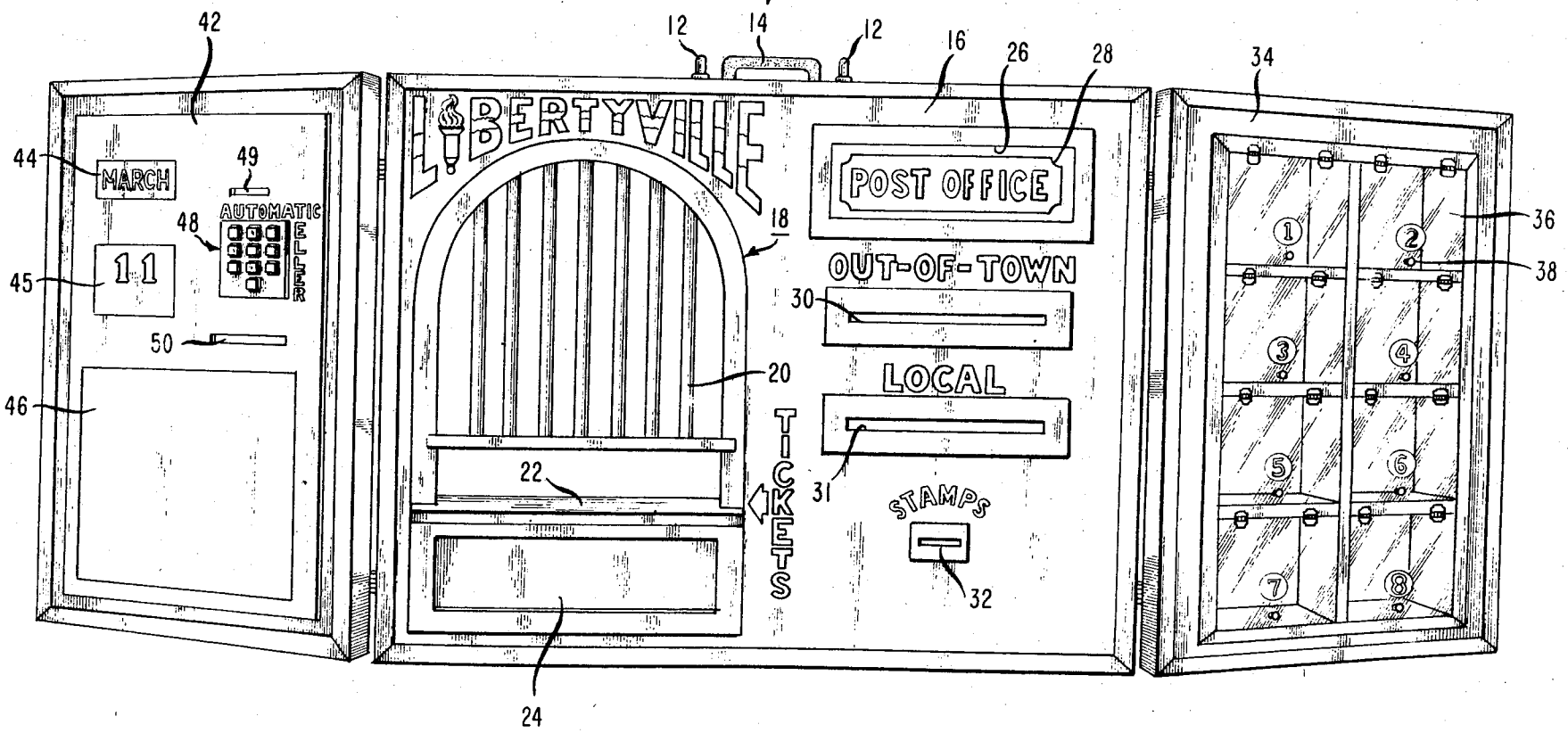
FIG. 1 represents a face or front view, partially perspective and diagrammatic, illustrating the replica device of this invention, this view showing the device in an open, erected condition for use.

The drawing accompanying, and forming part of, this specification disclose details of construction for the purpose of explanation, but structural details may be modified without departure from the concept and principles of the invention and the invention may be incorporated in other structural forms than shown.

DESCRIPTION OF THE PREFERED EMBODIMENT

Referring next to the drawings, and in particular to FIG. 1, a preferred arrangement is shown. This view has the device in an open condition wherein the construction and the use of the portable and foldable replica sructure suggest to the users commercial establishments with which children are familiar. This structure or device is contemplated to be foldable and, like a suitcase, be very portable. This replica embodiment is generally identified as 10. Releasable latch components 12 are depicted and may be of any commercial structure. Also shown is a handle 14 by which the device is moved or carried from place to place. In open condition, the replica device has a center or main panel 16 in which is formed a window 18 which may have a grill or bars 20. This portion is opened or closed as desired. A counter shelf 22 may also be opened or closed as desired. A box door or slot 24 is also depicted and is selectively opened or closed.

Still referring to FIG. 1, also selectively carried on this main panel 16 is an opening 26, and slot guides are provided on the inner side for retaining selected signs 28. These signs may have "open," "closed," "tickets," "on-the-air," "bank,[ "post office" and like indicia providing a wide-ranging use of the replica device. Also shown in and on this front panel are slots 30 and 31 which represent known post office slots indicating receivers for "out-of-town" and "local" mail. Another and shorter slot 32 is provided and may be used for dispensing "stamps" therethrough.

As viewed from the front, a right panel portion, identified as 34, is depicted as having a multiplicity of hinged doors 36. These doors are contemplated as having numbers or letters to indicate selective designation.

Each door 36 is provided with a knob or lock 38 which may be locked or unlocked by and with a key. Whether a knob or lock is used is merely a matter of selection since locks are more expensive than simple knobs. It is also to be noted that the age of the children may influence the selection of equipment. To prevent excessive opening movement of panel 34, means, as by a chain 40, a bar or the like, is provided so that this panel portion 34 may be swung into a determined-angle condition and position. This chain 40 is particularly seen in FIG. 2.

Figure 2:
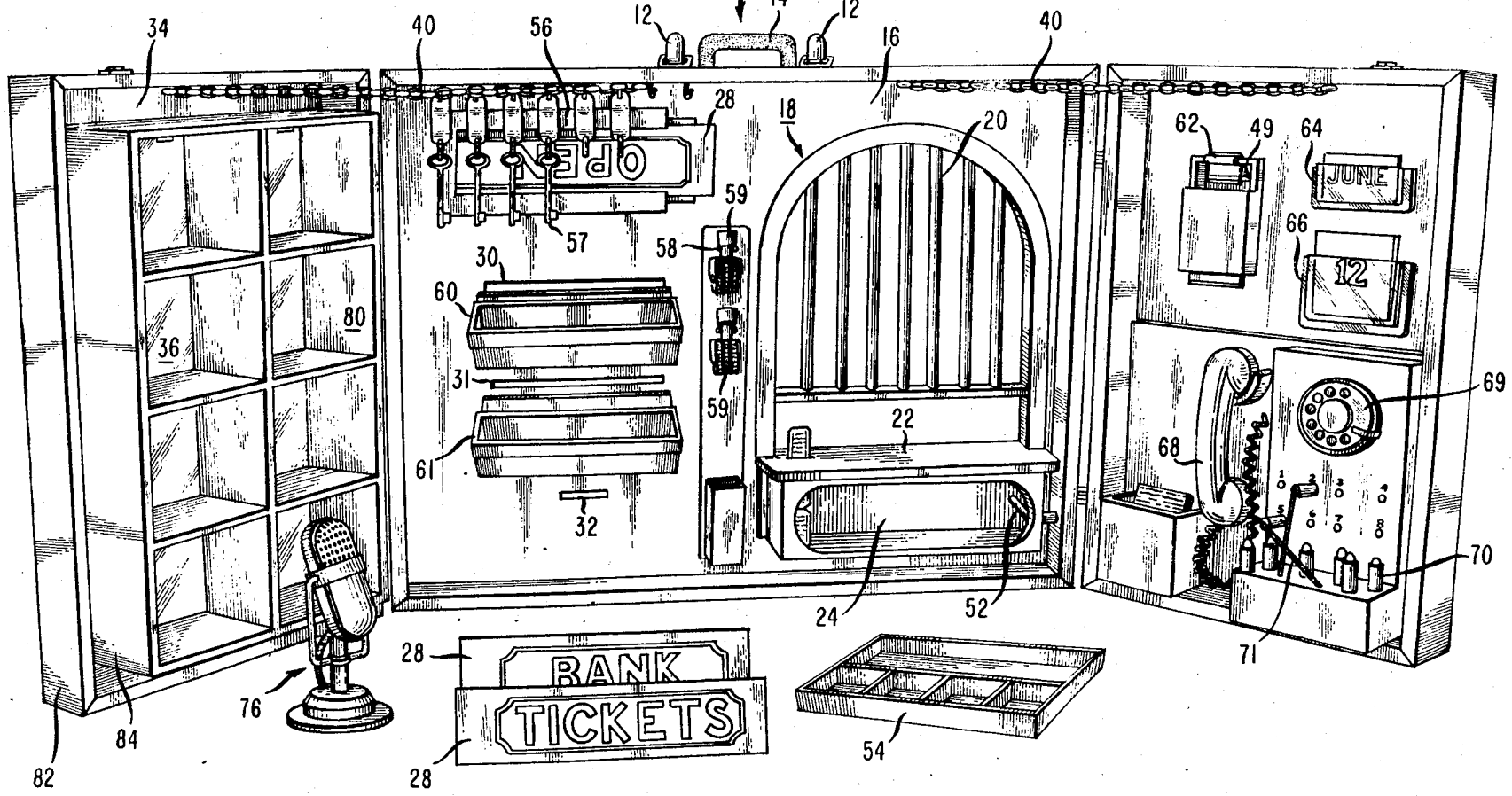
FIG. 2 represents an interior or rear view of the device of FIG. 1 and showing the components used in conjunction with the outer facade replica.

There is also provided a hinged, left-panel portion, identified as 42, which also is limited in its swing by a chain, cable or strap 40 like that for panel 34 as seen in FIG. 2. This left panel has calendar information provided in defined openings. In opening 44 may be displayed the month, which is carried on replaceable members. The date of the day is likewise removably carried on members displayed through an opening 45. Immediately below these openings in a blackboard or like surface 46 which may also serve as a bulletin board. To the right of the openings 44 and 45 is a plurality or pad of buttons 48, similar to those in a teller bank. Immediately above this pad of buttons is a slot 49 depicting an access means for insertion of an authorization card, and immediately below this pad is a discharge slot 50 from which money may be dispensed from the inside.

Reference is now made to FIG. 2 in which the interior of the replica device is depicted. When the replica device is in the open or use condition, the attendant behind the device performs many known functions. The counter box door 24 is also depicted and may be moved or swung from a closed to an open condition by a lever device 52 having one end pivotally secured to said door. A cash box 54 is also provided for stamps, play money, etc. A key retaining member 56 has hooks or pegs for storing the plurality of keys 57. These keys 57 are representative of keys that may be provided. These keys may be used for doors to rooms if the children's play is for a hotel or the keys may be used for mailbox doors 36 provided in panel 34. In connection with postal activites, there are provided spaced sets of pegs or like means 58 for retaining rubber stamps 59 used for date, play cancellation, special delivery, etc. Detachable containers 60 and 61 are disposed to receive and retain play mail inserted through slots 30 and 31. When the window 18, shelf 22 and slot 24 in the main panel 16 are closed, slot 32 is available for dispensing stamps.

The inner side of panel 42 is formed with a slot 49 which is provided so as to accept play teller cards inserted from the outer or front side. Slot 49 is contemplated to be provided with clamp means 62 in way of the slot so as to receive and retain the access card until the user wishes to remove said card from the front. Guideway and retaining means 64 is provided for the month card provided in and for opening 44. A guideway and retainer means 66 is also provided for the removable insertion thereinto of the date card visible in opening 45. Also depicted are a play telephone and a dial, identified as 68 and 69. When the device is used as a hotel, bank and the like, where a switchboard is a normal business procedure, immediately below dial 69 there are plugs and cords 70 and 71 which provide a simplified connection to a theoretical phone in a remote room. Also illustrated is a microphone 76 which is utilized when it is desired to use the replica device as a radio broadcast studio.

The inner side of panel 34, to the left of the depicted microphone 76, is provided with bins 80. These bins are, more or less, open to the inside and provide a four-sided enclosure substantially defining the opening of each hinged door 36. It is also to be noted that rim portions 82 are provided not only to stiffen the panels, but also provide spacing limits. These rim portions 82 conventionally extend as a four-sided frame around each panel.

USE AND OPERATION OF THE PREFERRED EMBODIMENT

Because of the many separable parts, it is contemplated that this device will be used by and with children above four years of age. As this is a suitcase-type of apparatus, the right- and left-hinged panel portions are swung outwardly to establish a secure erection. The latch coponents 12 are opened, and right-and-left panels 34 and 42 are swung outwardly to the extent limited by chains 40. The mail collectors 60 and 61 are placed under slots 30 and 31. The date, as to month and day and the like, is now inserted into guideways. Tickets, stamps and the money drawer are readied for use. Children thus have enough substantive props to enable two or more to play post office, in which letters, bills, orders and the like are mailed and received. Letters can be cancelled with stored rubber stamps. Banking may be done using the apparatus for bank transactions and with a teller window and automatic teller operation. This device may also be used as a hotel lobby desk, with the mailboxes for guest messages and mail. The switchboard may be used for calls to a guest room. The selling of tickets or use as a radio or police station are also contemplated. When play time for this device is over, the loose pieces are stored easily within the case and latch components are closed.

The device, as depicted, has the side panels (more or less) of equal extent so as to provide a folding means. The two folding panels add to substantially that extent of the center panel 16. All panel portions are shown with inwardly-extending rim or lip portions 82 to provide an interior cavity when folded. This extent and arrangement of lip are merely a matter of design for the storage of the members within the folded device.

It is to be noted that chains 40 are depicted, but cords, tapes or slideable metal strips may be employed. Whatever the means, it is contemplated that the device will be foldable as is a suitcase, without edge interference. As many of the components ar stored within the interior space, this device may employ slide guides for the many signs and for removably retaining the window closing board. The telephone 68 and dial module 69, as well as the switchboard, are shown carried on a panel member 84 which is removable for storage and is retained as shown when the device is erected for play. The board 46 may be a blackboard adapted for writing on by chalk or may be a cork board for retaining notes by thumbtacks. It is further contemplated that the board 46 may be, or have, an iron (steel) base to provide means for using magnetic retaining means. The age and preference of the children participants establishes the construction of the board provided. Small variations may be made in the device shown, but is is to be noted that, as arranged, this replica device is adapted to be used by two or more participating children.

Terms such as "left," "right," "up," "down," "bottom," "top," "front," "back," "in," "out," and the like are applicable to the embodiment shown and described in conjuntion with the drawings. These terms are merely for the purposes of description and do not necessarily apply to the position in which the replica device of establishments may be constructed or used.

While a particular embodiment of the foldable and portable replica of commercial establishments has been shown and described, it is to be understood that the invention is not limited thereto and protection is sought to the broadest extent the prior art allows.

What is claimed is:

1. A replica device of commercial establishments and with said device providing a portable case and in an opened condition for use as a toy for children, said case in a closed condition providing an interior cavity for protection and storage of loose components used therewith, said device including:

(a) a main panel member having an outwardly- and an inwardly-disposed portion;

(b) right- and left-panel portions hingedly attached to main-panel portion and with limiting means associated with the main panel and hinged panels to establish the outward and open swing of each hinged panel to a predetermined extent;

(c) a window formed in the main panel member;

(d) a counter shelf disposed substantially normal to said main panel member;

(e) a box door associated with the main panel;

(f) means for securing and displaying signs selectively indicating the replica usage and below said sign display providing slots for main drops, stamps and the like;

(g) a plurality of doors provided in one of hingedly-attached panel portions, each plurality of doors disposed for selective individual opening;

(h) day, date and like indicia display means provided on a removable panel;

(i) means for moving of said box door;

(j) detachable containers attachable to the interior of the main panel member so as to receive and retain items inserted through said slots;

(k) bank teller replica apparatus carried so as to be simulated and actuated from the exterior of the device and with slots for receiving and dispensing money, and (l) means for folding the several panel portions into a suitcase-type of device and with selectively operable latch means for retaining said device in a closed condition until openingand using said device is desired.

2. A replica device as in claim 1 in which each of the panel members has frame border portions providing edges which, in a closed condition, abut each other to provide a closure and retaining barrier to material interior of these edges.

3. A replica device as in claim 2 in which the device is provided with an attached handle by which the replica device is grasped for moving and arranging said device.

4. A replica device as in claim 2 in which the limiting means for establishing the outer limit of swing of an attached panel is a chain, cord and the like, and having two ends, one end secured to the main panel and the other end secured to an associated hinged panel.

5. A replica device as in claim 2 in which the hinged panels, when swung to an open condition, provide with the edges a supporting surface substantially in a common plane.

6. A replica device as in claim 1 in which the window in the main panel is provided with an open grill, bars and the like to provide a barrier guard from the exterior to the interior of the erected device.

7. A replica device as in claim 1 in which the plurality of hingedly-attached doors is open to bin structure defining each of the door openings, said bin structure extending inwardly from the panel.

8. A replica device as in claim 1 in which the inner side of the panel containing the window also includes means for removably retaining rubber stamps for cancellations, date and the like.

9. A replica device as in claim 1 in which the inner side of a panel includes a replica telephone, dialing and associated members providing play telephone capability.

10. A replica device as in claim 9 which further includes apparatus depicting cords and connectors for room communication.

11. A replica device as in claim 1 in which the panel containing the bank teller apparatus also includes slots for insertion of an authorization card and a slot for passing money therethrough.

12. A replica device as in claim 1 in which there is provided on an interior side of a panel a key board having a plurality of hooks and with keys provided for removably placing on said hooks.

13. A replica device as in claim 1 in which the means for securing the displayed signs are spaced and opposed slide guides are adapted to receive and slideably retain a sign.

14. A replica device as in claim 1 in which the day and date indicia display are individual signs and are removable retained on the interior side of a panel by receiving and retaining pockets.

* * * * *